US007664433B2

(12) United States Patent
Fujita et al.

(10) Patent No.: US 7,664,433 B2
(45) Date of Patent: Feb. 16, 2010

(54) CLEANING OF A CHARGING MEMBER IN AN IMAGE FORMING APPARATUS

(75) Inventors: Tetsumaru Fujita, Hyogo (JP); Yoshio Sakagawa, Hyogo (JP); Yuji Nagatomo, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 36 days.

(21) Appl. No.: 12/021,630

(22) Filed: Jan. 29, 2008

(65) Prior Publication Data

US 2008/0187360 A1 Aug. 7, 2008

(30) Foreign Application Priority Data

Feb. 5, 2007 (JP) ..... 2007-025571

(51) Int. Cl.
*G03G 15/02* (2006.01)

(52) U.S. Cl. ..... 399/174

(58) Field of Classification Search ..... 399/174, 399/100, 175, 176
See application file for complete search history.

(56) References Cited

U.S. PATENT DOCUMENTS 5,576,805 A * 11/1996 Ishihara et al. ..... 399/176
5,940,661 A * 8/1999 Yagi et al. ..... 399/174
6,615,010 B2 * 9/2003 Hirabayashi et al. ..... 399/174
2007/0025766 A1 * 2/2007 Kamoshida et al. ..... 399/159
2007/0065179 A1 3/2007 Fujita
2007/0172259 A1 7/2007 Fujita
2007/0280735 A1 12/2007 Nagatomo

FOREIGN PATENT DOCUMENTS

JP 58-42067 3/1983
JP 58-54644 4/1983

OTHER PUBLICATIONS

U.S. Appl. No. 12/204,083, filed Sep. 4, 2008, Fujita, et al.
U.S. Appl. No. 12/187,021, filed Aug. 6, 2008, Shono, et al.

* cited by examiner

*Primary Examiner*—Quana M Grainger
(74) *Attorney, Agent, or Firm*—Oblon, Spivak, McClelland, Maier & Neustadt, L.L.P.

(57) ABSTRACT

An image forming apparatus includes a charging device for charging a photosensitive element having a moving surface, by bringing a charging roller, to which voltage is applied, into pressure-contact with the photosensitive element, wherein to the charging member there is applied voltage for forming an electric field such that toner adhered to the charging roller surface at a non-image forming area is oriented towards the photosensitive element. The image forming apparatus is provided with pressure contact force modifying means for making the pressure contact force of the charging roller against the photosensitive element at the non-image forming area greater than that at an image forming area.

12 Claims, 8 Drawing Sheets

FIG. 11

| | AMOUNT OF BITE (mm) | NIP WIDTH (mm) | EVALUATION RESULTS OF CHARGING BRUSH ROLLER CLEANING ABILITY | EVALUATION RESULTS OF CHARGING BAR BRUSH CLEANING ABILITY |
|---|---|---|---|---|
| No. 1 | 0 | 0 | × | × |
| No. 2 | 0.1 | 2 | × | ○ |
| No. 3 | 0.2 | 3 | ◎ | ◎ |
| No. 4 | 0.25 | 3.3 | ◎ | ◎ |

FIG. 12

| | URGING FORCE ($N/mm^2$) | AMOUNT OF BITE (mm) | NIP WIDTH (mm) | EVALUATION RESULTS OF CHARGING ROLLER CLEANING ABILITY |
|---|---|---|---|---|
| No. 1 | 0 | 0 | 0 | × |
| No. 2 | 0.02 | 0.1 | 2 | × |
| No. 3 | 0.04 | 0.2 | 3 | ○ |
| N. 4 | 0.08 | 0.25 | 3.3 | ○ |

CLEANING OF A CHARGING MEMBER IN AN IMAGE FORMING APPARATUS

BACKGROUND OF THE INVENTION

1. Field of the Invention

The present invention relates to an image forming apparatus such as a copier, a fax machine, a printer or the like, and more particularly to a charging device of an image carrier used in such an image forming apparatus.

2. Description of the Related Art

Contact-type charging devices, in which an image carrier is brought into pressure contact with a charging member such as a charging roller, charging brush or the like to which voltage is applied, are known as conventional charging devices of image carriers. Such contact-type charging devices are likely to exhibit problems over time such as contamination, caused by residual toner on the image carrier becoming adhered to the charging member, which preclude uniform charging. A cleaning member such as a pad, roller or the like is therefore provided for cleaning the charging member. However, providing a cleaning member drives costs up. Another problem is contamination of the cleaning member over time, which impairs the function of the cleaning member.

Also known are image forming apparatuses in which an electric field is formed between the image carrier and the charging member such that toner adhered to the surface of the charging member is caused to migrate towards the image carrier. By way of such an electric field, toner adhered to the surface of the charging member is thus cleaned electrostatically by the image carrier (Japanese Unexamined Patent Application Laid-open No. S58-42067 and Japanese Unexamined Utility Model Application Laid-open No. S58-54644).

The above image forming apparatuses where a charging member is cleaned electrostatically are problematic, however, in that toner strongly adhered to the charging member cannot be fully removed.

SUMMARY OF THE INVENTION

In light of the above, it is an object of the present invention to provide an image forming apparatus in which a charging member of a contact-type charging device can be cleaned well and inexpensively.

In an aspect of the present invention, an image forming apparatus comprises a charging device for charging a surface of an image carrier having a moving surface, by bringing a charging member, to which voltage is applied, into pressure-contact with the image carrier; an electrostatic latent image forming device for forming an electrostatic latent image on the image carrier; a developing device for developing an electrostatic latent image on the image carrier; an application device for applying, to the charging member, voltage for forming an electric field such that toner adhered to a surface of the charging member at a non-image forming area is oriented towards the image carrier; and a pressure contact force modifying device for making a pressure contact force of the charging member against the image carrier at the non-image forming area greater than that at an image forming area.

BRIEF DESCRIPTION OF THE DRAWINGS

The above and other objects, features and advantages of the present invention will become more apparent from the following detailed description taken with the accompanying drawings in which:

FIG. 11 is a diagram illustrating the relationship between change in nip width and urging force of a charging roller in an image forming area; and FIG. 12 is a diagram illustrating the relationship between change in nip with and amount of bite into the charging roller in an image forming area.

DESCRIPTION OF THE PREFERRED EMBODIMENTS

An explanation follows next on an embodiment where the present invention is used in a printer as an image forming apparatus.

First, the configuration and operation of the printer according to the present embodiment is explained.

Figure 1:
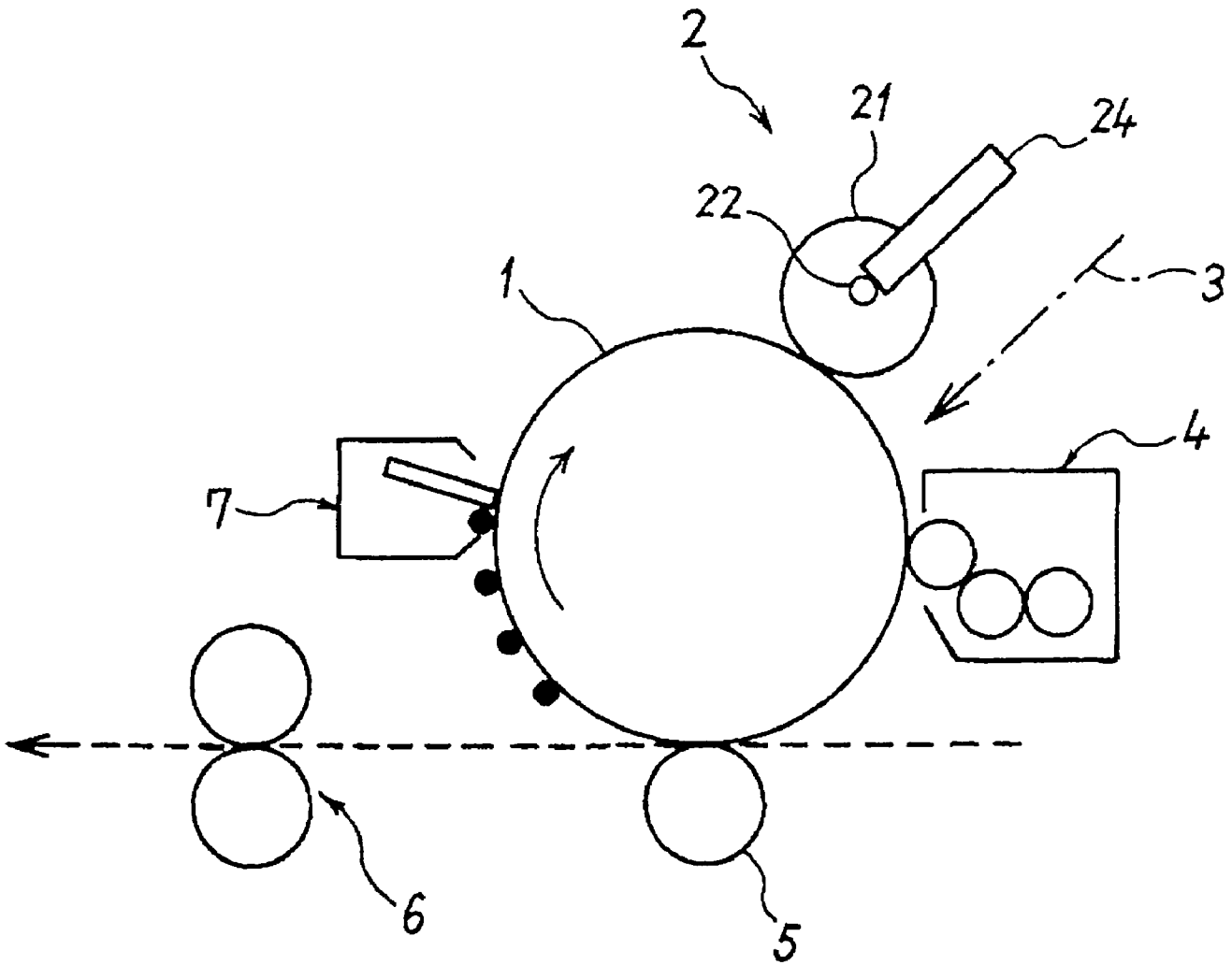
FIG. 1 is a diagram illustrating schematically the configuration of a printer in an embodiment of the present invention.

FIG. 1 illustrates schematically the configuration of a printer as a whole according to the present embodiment. The present printer comprises a photosensitive element 1 as an image carrier. A charging device 2, an exposure device 3 as an electrostatic latent image forming means, a developing device 4, a transfer device 5, and a cleaning device 7 are sequentially arranged, in this order, around the photosensitive element 1, in the rotation direction of the latter. A fixing device 6 is arranged more downstream than the transfer device 5 in the transport direction of a recording medium. In a printer thus configured, firstly the photosensitive element 1 is charged to a predefined potential by the charging device 2. An electrostatic latent image is formed next through exposure of the surface of the charged photosensitive element 1 by the exposure device 3. The developing device 4 turns then the electrostatic latent image into a toner image. The toner image is transferred to a recording medium by the transfer device 5. The transferred toner image is fixed onto the recording medium by the fixing device 6, to yield an image. Meanwhile, transfer residual toner on the photosensitive element 1 is removed by the cleaning device 7.

The charging device 2, which is the characterizing feature of the present invention, is explained next.

Figure 2:
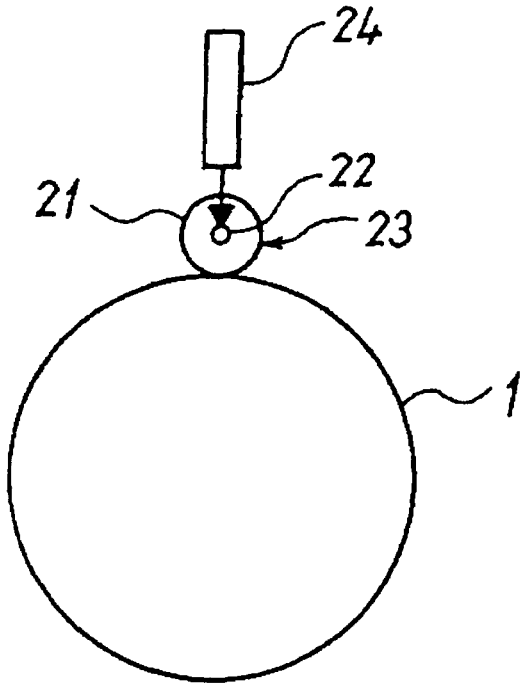
FIG. 2 is a diagram illustrating schematically the configuration of a charging device of the printer using a charging roller.

The charging device 2 is a contact-type charging device for charging the photosensitive element 1 by bringing into pressure contact a charging member, to which voltage is applied, with the surface of the photosensitive element 1. In FIG. 1 a charging roller 21 comprising an elastic roller is used as the charging member. FIG. 2 illustrates schematically the configuration of the charging device 2 using the charging roller 21. The charging roller 21 has a metallic rotary shaft member 22 rotatably journaled in a bearing not shown, and an elastic layer 23, provided on the surface of the rotary shaft member 22, and containing conductive particles. The elastic layer 23 is subjected to a surface layer treatment. The surface of such a charging roller 21 is brought into pressure contact with the photosensitive element 1 as the rotary shaft member 22 is rotated in the counterclockwise direction of the figure by driving means not shown. Charging bias is applied by a charging bias supply device (not shown), comprising a power supply, wiring and the like, that is connected to the rotary shaft member 22. The charging roller 21 applies for instance a negative-polarity charging bias to the surface of the photosensitive element 1, so as to uniformly charge the latter negatively. Specifically, when DC alone is used as the charging bias, the photosensitive element 1 is charged to a surface potential of −400 to −1000 V by applying a voltage of −800 to −1500 V. When AC voltage superposed to DC voltage is used as the charging bias, with a view to achieving uniform charging, the photosensitive element 1 is charged to a surface potential of −400 to −1000 V by applying a voltage in which a Vp-p AC voltage of 600 to 1500 V is superposed on a DC voltage of −400 to −1000 V.

In the charging roller 21, the rotary shaft member 22 has a diameter of 3 mm or more, and the elastic layer 23 has a thickness of 0.5 to 10 mm, preferably of 0.5 to 3 mm. The outer diameter of the charging roller 21 ranges from 5 to 20 mm. As the elastic layer 23 there is used an elastic layer having a hardness of 50 to 75°(JIS-A) and a volume resistivity of $10^4$ to $10^7$ Ω·cm. The surface layer treatment includes coating in which a silicone or the like, present in, for instance, rubber covering a tube, is exposed without evaporating. The charging roller 21 is crown-shaped, to a crown of about 200 μm at most. A spring or the like is used as a means for bringing the charging roller 21 into pressure contact with the photosensitive element 1. The force exerted ranges from about 1.5 to 8 N on both sides, the nip width ranges from 0.5 to 3 mm, and the amount of bite ranges from 0.1 to 1 mm. From set-up onwards, the charging roller 21 is urged to be normally in pressure contact with the photosensitive element 1. When prior to set-up the charging roller 21 and the photosensitive element 1 are brought into pressure contact, the portion in contact with the photosensitive element 1 is deformed, which may give rise to non-uniform cycles of the charging roller 21. Therefore, it is preferable to spare the charging roller 21, keeping it away from the photosensitive element 1, until set up. Similarly, the charging roller 21 and the photosensitive element 1 are preferably kept separated when main power is to be turned off for long periods of time. With a view to cutting costs, the charging roller 21 may be rotationally driven by being in pressure contact with the photosensitive element 1. Surface motion speed differences between the charging roller 21 and the photosensitive element 1 can be achieved by providing gears in the charging roller 21.

In such a charging device 2, the charging roller 21 becomes contaminated when there is residual toner, from cleaning or the like, on the photosensitive element 1. When DC is used as the charging bias, for instance, toner reversely charged relative to the charging bias (herein, positively-charged toner) is likely to adhere to the charging roller 21. Once adhered to the charging roller 21, toner in that state is hard to be brought back to the photosensitive element 1. Bias is thus applied for forming an electric field such that toner adhered to the charging roller 21 migrates to the photosensitive element 1 at a non-image forming area. The charging roller 21 is thus cleaned electrostatically by causing toner adhered to the charging roller 21 to migrate towards the photosensitive element 1.

A pressure contact force modifying means 24 is further provided for making the pressure contact force of the charging roller 21 against the photosensitive element 1 larger during electrostatic cleaning than during image formation. As the pressure contact force modifying means there may be used an actuator for urging the rotary shaft member 22 of the charging roller 21 against the photosensitive element 1.

Figure 3:
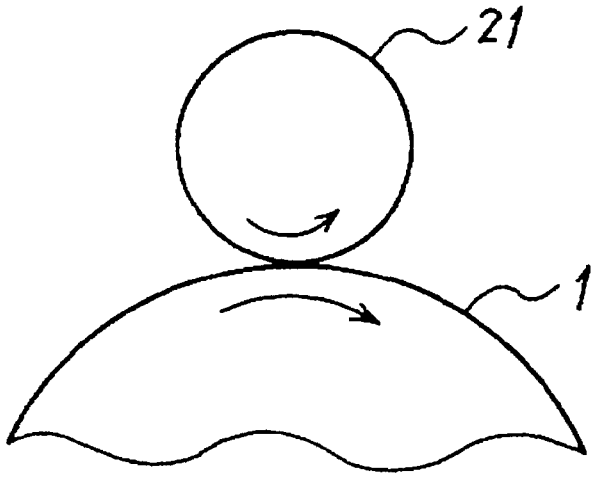
FIG. 3 is a diagram for explaining a pressure contact state between the charging roller and a photosensitive element in an image forming area of the printer.
Figure 4:
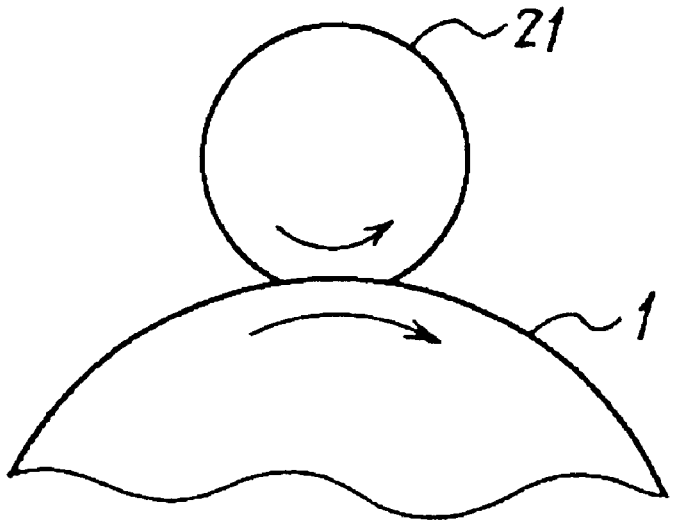
FIG. 4 is a diagram for explaining a pressure contact state between the charging roller and the photosensitive element in a non-image forming area of the printer.

FIG. 3 is an explanatory diagram of the pressure contact state between the photosensitive element 1 and the charging roller 21 at the image forming area. The charging roller 21 and the photosensitive element 1 are brought into pressure contact in such a way that the pressure contact state yields uniform charging. FIG. 4 is an explanatory diagram of the pressure contact state between the photosensitive element 1 and the charging roller 21 during non-image formation times, when the pressure contact force is stronger than during image formation. As a result, the width between the charging roller 21 and the photosensitive element 1 becomes larger, as does the force with which the photosensitive element 1 slides frictionally against the surface of the charging roller 21. Toner adhered to the charging roller 21, in addition to being electrostatically oriented towards the photosensitive element 1, is detached readily, also mechanically, through sliding friction against the photosensitive element 1, thanks to a large nip width and large frictional forces. Thereby, even toner strongly adhered to the charging roller 21 can be cleaned easily by the photosensitive element 1. In a configuration where the charging roller 21 is rotationally driven by the photosensitive element 1, the charging roller 21 rotates by being dragged, which affords as a result large frictional forces. This effect of enhanced frictional forces is particularly conspicuous when the surface motion speed between the photosensitive element 1 and the charging roller 21 is relatively large.

When the pressure contact force between the charging roller 21 and the photosensitive element 1 at the image forming area is more intense, uniform charging may fail to be obtained, and toner adhering electrostatically to the charging roller 21 may be likelier to become embedded therein. An intense pressure contact force at normal times can also give rise to problems such as filming or the like caused by wear of the photosensitive element 1 and/or components adhering to the photosensitive element 1. In the printer of the present embodiment, the pressure contact force between the photosensitive element 1 and the charging roller 21 is intensified by the pressure contact force modifying means 24 only during electrostatic cleaning of the charging roller 21 carried out at the non-image forming area. Hence, the charging roller 21 is cleaned well as a result, without affecting the charging characteristic of the image area or impairing durability. Also, simply providing the pressure contact force modifying means 24 does away with the need for providing a cleaning member for cleaning the charging roller 21. This allows preventing cost increases.

Figure 5:
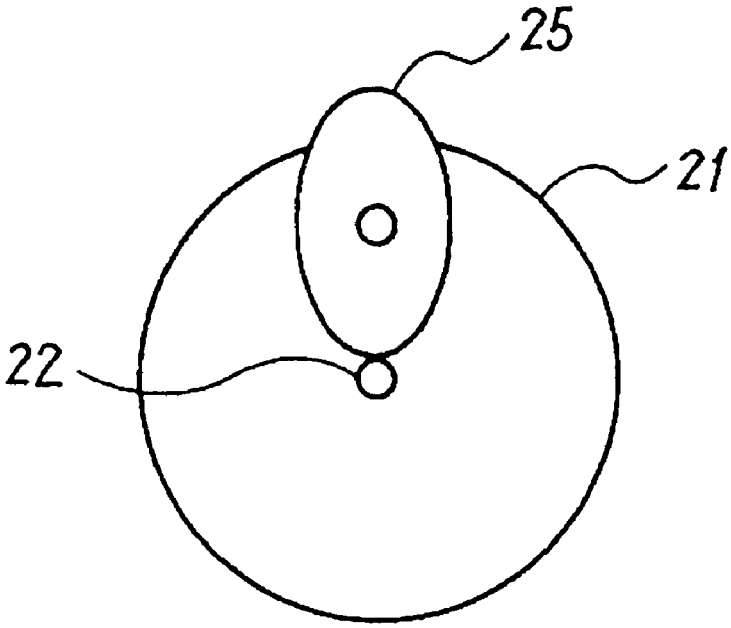
FIG. 5 is a diagram illustrating schematically a configuration in which an eccentric cam is used as a pressure contact force modifying means.
Figure 6:
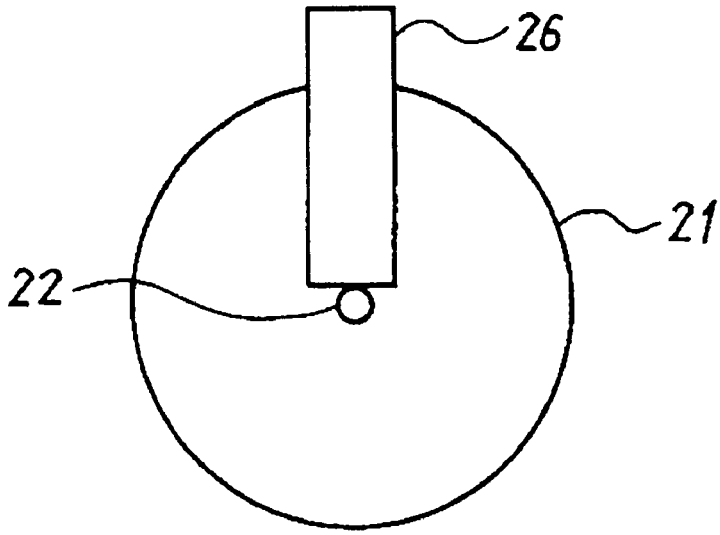
FIG. 6 is a diagram illustrating schematically a configuration in which a piezoelectric member is used as a pressure contact force modifying means.
Figure 7:
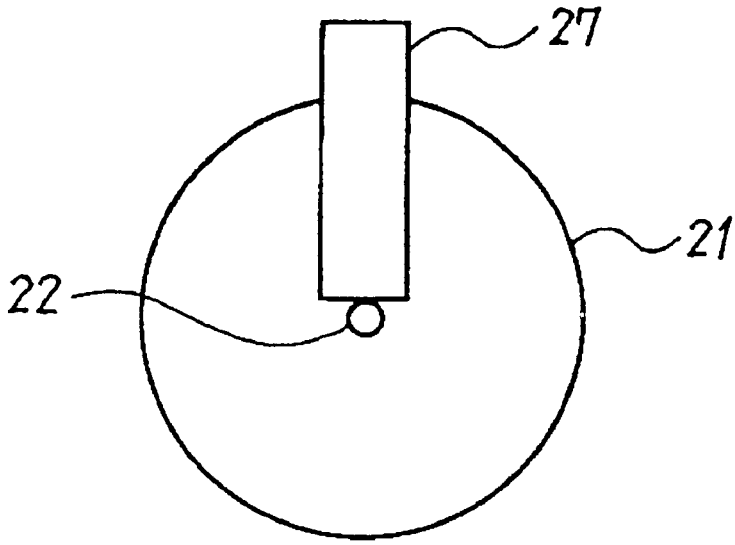
FIG. 7 is a diagram illustrating schematically a configuration in which a magnetostrictive member is used as a pressure contact force modifying means.

As the pressure contact force modifying means there can be used, alternatively, an eccentric cam 25 such as the one illustrated in FIG. 5, for urging the rotary shaft member 22 of the charging roller 21 against the photosensitive element 1. There can also be used a pressure contact force modifying means comprising a piezoelectric member 26 for urging the rotary shaft member 22 of the charging roller 21 against the photosensitive element 1, and voltage application means (not shown) for applying voltage to the piezoelectric member 26, as illustrated in FIG. 6. Likewise, there can also be used a pressure contact force modifying means comprising a magnetostrictive member 27 for urging the rotary shaft member 22 of the charging roller 21 against the photosensitive element 1, and magnetic field applying means for applying a magnetic field to the magnetostrictive member 27, as illustrated in FIG. 7. The magnetostrictive member 27 is a member that deforms upon application of a magnetic field.

Figure 8:
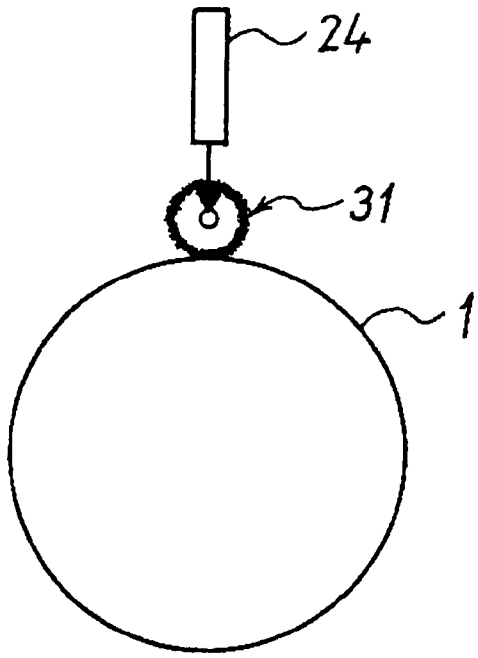
FIG. 8 is a diagram illustrating schematically the configuration of a charging device using a charging brush roller.
Figure 10:
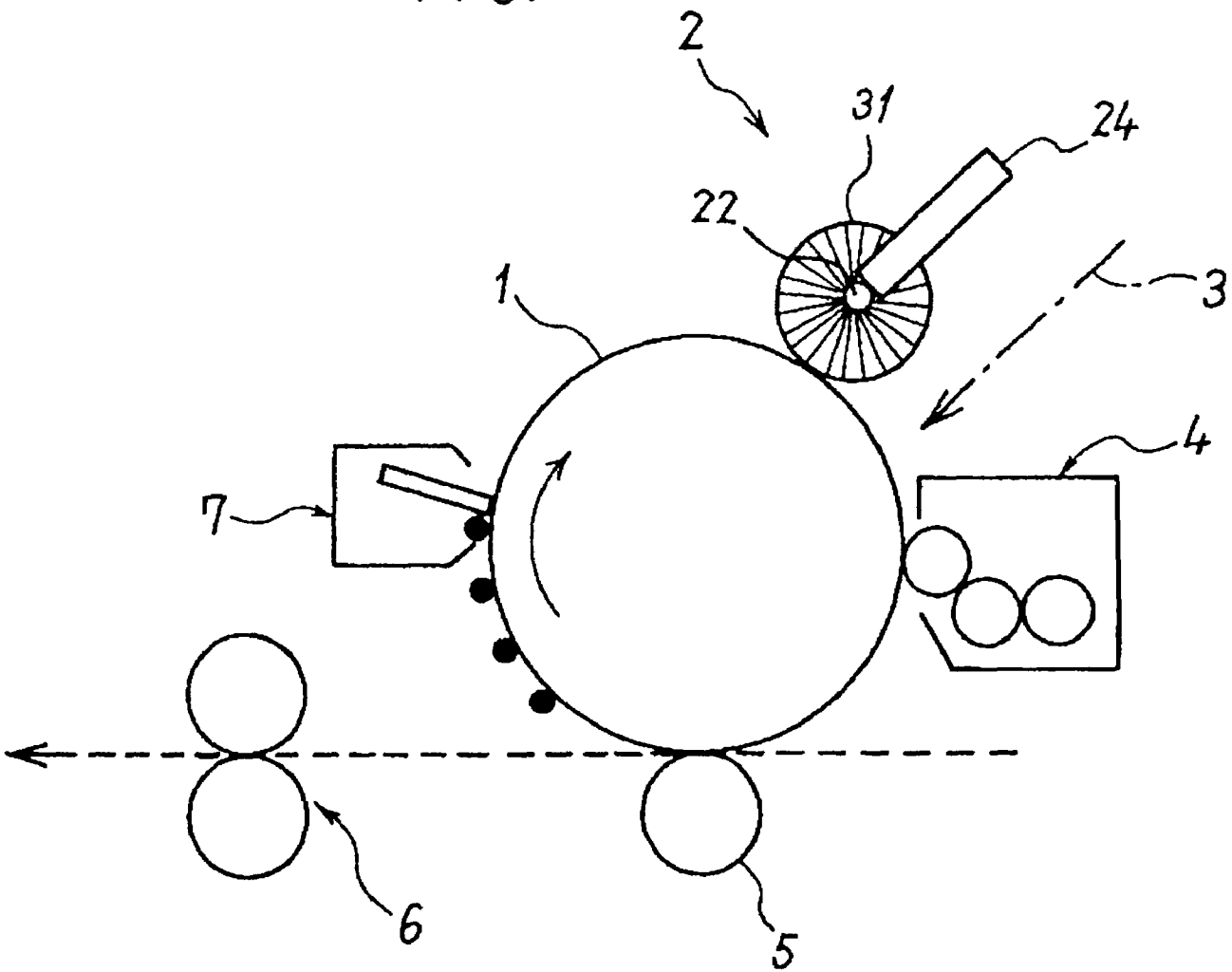
FIG. 10 is a diagram illustrating schematically the configuration of a printer using a charging brush roller.

Other than the above charging roller 21, a rotatable charging brush roller 31 illustrated in FIG. 8 can be used as the charging member. The charging brush roller 31 has a metallic rotary shaft member 32 and plural conductive flocked fibers 33 set standing on the rotary shaft member 32. To the rotary shaft member 32 there is applied charging bias comprising voltage in which AC is superposed on DC, from a charging bias supply device not shown. The tips of the flocked fibers 33 are made to slide frictionally over the photosensitive element 1 as the rotary shaft member 32 is rotated around the center thereof, in the counterclockwise direction of the figure, by driving means not shown. As a result, the charging brush roller 31 charges uniformly the surface of the photosensitive element 1. FIG. 10 illustrates schematically the configuration of a printer using the charging brush roller 31.

The plural flocked fibers 33 of the charging brush roller 31 are conductive fibers cut to a predefined length. As the material of the conductive fibers there may be used, for instance, resin materials such as nylon 6 (TM), nylon 12 (TM), acrylic fibers, vinylon, polyester and the like. Such resin fibers are imparted conductivity through dispersion therein of conductive particles such as carbon, metallic fine powder or the like. In terms of manufacturing costs and low Young modulus, a nylon resin with carbon dispersed therein is preferred. Carbon may be dispersed unevenly in the fibers. As the material of the rotary shaft member 32, which is the substrate on which the plural flocked fibers 33 are set standing, there may be used stainless steel such as SUS303, SUS304, SUS316, SUS416, SUS420, SUS430 or the like. Herein there may be used free cutting steel such as SUM22, SUM23, SUM23L, SUM24L, or a plated product of the foregoing. In terms of cost and safety (absence of lead) there is preferably used SUM22 or SUM23 having been subjected to a surface plating treatment.

Figure 9:
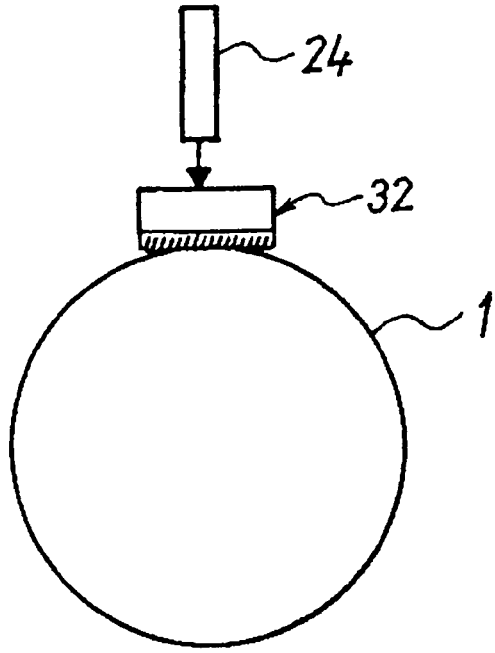
FIG. 9 is a diagram illustrating schematically the configuration of a charging device using a charging bar brush.

As the charging member there can also be used a charging bar brush 34 in which the above flocked fibers 26 are shaped as a bar brush, as shown in FIG. 9.

In addition to the configuration of the above printer, such a charging device 2 can be used in a cleanerless printer in which there is provided no cleaning blade device 7 for cleaning transfer residual toner on the photosensitive element 1, and in which transfer residual toner is recovered at the developing device 3. A cleanerless printer has the advantages of, for instance, reducing the load on the photosensitive element 1 posed by the cleaning device, enhancing durability, saving costs, reducing size, allowing toner recycling and the like. In such cleanerless systems, however, the above-described residual toner contaminates the charging roller 21 considerably. Thus, using the above charging device 2 makes it easier for the photosensitive element 1 to clean well toner adhered to the charging roller 21.

Experiments carried out by the three inventors are explained next.

EXPERIMENT 1

The inventors prepared a test machine having a configuration identical to that of the above cleanerless printer. The cleaning ability of the charging roller 21 was evaluated using this test machine, by appropriately varying the pressure contact force of the charging roller 21 against the photosensitive element 1. Specifically, a monochrome half chart (halftone gradation image) was printed, under the below-described conditions, on A4 paper with a 5% image area ratio. To evaluate the cleaning ability of the charging roller 21, 1000 sheets were continuously printed with a non-image forming area in which the pressure contact force was modified, every 4 seconds for every 50 sheets, by the pressure contact force modifying means 24. Cleaning ability was evaluated perceptually based on longitudinal black streaks and stripes on the half chart caused by roller contamination. Specifically, the cleaning ability was rated into three grades, namely (x) for conspicuous streaks and stripes, (○) for a non-problematic level in which streaks or stripes were absent on a 600 DPI two-by-two dot image, and (⊕) for a non-problematic level even for a one-by-one dot image. As regards uneven charging ○ and ⊕ were judged as allowable, while x was deemed to be a level that interferes with printing in practice.

The numerals before and after "by" in "two-by-two" and "one-by-one" denote the smallest difference between dots in halftone representation. In case of a one-by-one image, in which half tone is represented in a one-by-one scheme, the smallest difference between dots is equivalent to two dot lengths. In case of, for instance, a two-by-two image, in which half tone is represented in a two-by-two scheme, the smallest difference between dots is equivalent to four dot lengths.

The specific conditions in the test machine were: linear speed of the photosensitive element 100 mm/sec, employing a developing device using one-component contact developing, and using, as toner, pulverized toner having a volume average particle size of 8.5 μm and subjected to an external additive treatment. As the charging roller 21 there was used roller having a diameter of 10 mm in which a rotary shaft member 22 having a diameter of 6 mm was covered with a 2 mm-thick elastic layer 23. The volume resistivity of the elastic layer 23 used was of $10^6$ Ω·cm. The crown shape of the charging roller 21 was of 50 μm. The spring-exerted pressure contact force of the charging roller 21 against the photosensitive element 1 at the image forming area was of 3 N, and the nip width at the image forming area was of 1 to 2 mm. The charging roller 21 was rotationally driven by pressure contact with the photosensitive element 1. In the test machine, the charging bias comprised DC −1200 V at the image forming area and DC +300 V at the non-image forming area. The pressure contact force was modified by adjusting the urging force of the charging roller 21 so as to appropriately modify the nip width, as illustrated in FIG. 11, relative to the nip width of the image forming area.

As can be seen in the evaluation of nip width and cleaning ability of FIG. 11, when the abutting force between the charging roller 21 and the photosensitive element 1 at the non-image forming area was smaller than (No. 1) or the same (No. 2) as that at the image forming area, good cleaning performance failed to be achieved. On the other hand, good cleaning performance was achieved when the abutting force between the charging roller 21 and the photosensitive element 1 at the non-image forming area was greater (Nos. 3, 4) than that at the image forming area.

EXPERIMENT 2

Cleaning ability was similarly evaluated using the charging brush roller 31 illustrated in FIG. 8 and the charging bar brush 34 illustrated in FIG. 9, by varying the pressure contact force, depending on the image forming area, during non-image formation times. As the charging brush roller 31 there was used a roller-shaped member having a diameter of 11 mm in which flocked fibers having a volume resistivity of about $10^5$ Ω·cm, comprising 2 denier-thick conductive nylon fibers that contain conductive particles, to a flocking density of 200,000/inch$^2$, were set standing on a rotary shaft member having a diameter of 5 mm. In Experiment 2, as in Experiment 1, the pressure contact force was adjusted by taking the nip width as a reference and appropriately modifying the nip width as illustrated in FIG. 12.

As can be seen in the evaluation of nip width and cleaning ability of FIG. 12, improving cleaning performance was achieved as the abutting force between the charging roller 21 and the photosensitive element 1 at the non-image forming area was made greater than that at the image forming area. The charging brush roller 31 and the charging bar brush 34 exhibited better cleaning ability results than the charging roller 21 of FIG. 11. When the charging brush roller 31 was used, for instance, there was obtained a non-problematic level (○) in which no streaks or stripes appeared on a 600 DPI two-by-two dot image, even for a nip width of 2 mm. This enhanced cleaning performance is ostensibly the result of the increased contact area between the charging member and the photosensitive element 1, brought about by the greater pressure contact force and greater amount of bite afforded by the brush, since not only the tips but also the roots of the brush come into contact with the photosensitive element 1.

During electrostatic cleaning of a contact-type charging member such as the charging roller 21, the charging brush roller 31 or the charging bar brush 34, thus, toner adhered to the charging member, in addition to being electrostatically oriented towards the photosensitive element 1, is detached readily, also mechanically, from the charging member, by increasing the pressure contact force of the charging member against the photosensitive element 1. Thereby, even toner strongly adhered to the charging member can be cleaned easily. The above Experiments 1 and 2 were forced experiments, and hence there was provided, during continuous printing of 1000 sheets, a non-image forming area in which the pressure contact force of the charging member against the photosensitive element 1 was increased every 4 seconds for every 50 sheets. Such timing can be appropriately set during electrostatic cleaning at the non-image forming area upon actual use of the printer. For instance, the pressure contact force of the charging member against the photosensitive element 1 is increased at the non-image forming area when the surface of the photosensitive element 1 moves during image formation start, or when the surface of the photosensitive element 1 moves during image formation termination. Such timings are preferable since no loss of productivity is incurred on account of time dedicated for cleaning the charging roller 21.

Toner having a volume average particle size of 8.5 μm was employed as the toner used in the printer, but good cleaning performance is achieved by employing toner having a volume average particle size of 6 μm or more. Good cleaning performance is achieved also using toner having a small differential, no greater than 10%.

Preferably, the photosensitive element 1 used has a surface friction coefficient of 0.1 to 0.5. Cleaning ability becomes dramatically impaired when the surface friction coefficient of the photosensitive element 1 is smaller than 0.1. On the other hand, a surface friction coefficient greater than 0.5 results in good cleaning ability, but also in substantial wear of the photosensitive element 1, which impairs the durability thereof.

After modification of the charging bias applied to the charging roller 21 at the non-image forming area, the pressure contact force modifying means may increase the pressure contact force of the charging roller 21 against the photosensitive element 1 making it greater than that at the image forming area. In this case the charging roller 21 is cleaned electrostatically, and the amount of toner is reduced. The little toner remaining adhered to the charging roller 21 is cleaned by frictional forces through contact with the photosensitive element 1. The charging roller 21 can be effectively cleaned thereby.

The present embodiment has been explained based on an example using DC as the charging bias, in which reversely-charged toner adhered readily to the charging roller 21. However, the present embodiment is not limited thereto. When using AC superposed onto DC as the charging bias, for instance, regular-polarity toner (herein negative-polarity toner) can also adhere readily on account of an electric field resulting from AC. Also, toner adhered to the charging roller 21 is gradually charged by the charging bias up to a regular charging polarity, depending on conditions such as, for instance, the charging bias and the time toner is adhered to the charging roller 21. At any rate, the embodiment can be employed, to the same effect, in a device where charging bias is modified in such a way so as to form an electric field whereby toner adhered to the charging roller 21 at a non-image forming area is oriented towards the photosensitive element 1.

In the above embodiment the charging device 2 was explained using a printer for monochrome image formation. However, the embodiment is not limited thereto, and thus the charging device 2 can also be used in a tandem-type full color image forming apparatus employing an intermediate transfer element, or in a one-drum full color image forming apparatus in which toner of plural colors is supplied to one photosensitive element 1.

Thus, in the printer of the present embodiment comprising the charging device 2 for charging the photosensitive element 1 by bringing into pressure contact the photosensitive element 1 with the charging roller 21 to which voltage is applied, the voltage applied to the charging roller 21 is modified to a voltage for forming an electric field such that toner adhered to the surface of the charging roller 21 faces towards the photosensitive element 1, at the non-image forming area relating to the surface movement direction of the photosensitive element 1, while there is provided the pressure contact force modifying means 24 for making the pressure contact force of the charging roller 21 against the photosensitive element 1 larger than that at the image forming area. During electrostatic cleaning of the charging roller 21, the nip width between the charging roller 21 and the photosensitive element 1 is increased, and the sliding friction force of the photosensitive element 1 against the surface of the charging roller 21 is also made larger by the pressure contact force modifying means 24, which causes the pressure contact force of the charging roller 21 against the photosensitive element 1 to increase. Toner adhered to the charging roller 21, in addition to being electrostatically oriented towards the photosensitive element 1, is detached thus readily, also mechanically, through sliding friction against the photosensitive element 1 thanks to a large nip width and large frictional forces. Thereby, even toner strongly adhered to the charging roller 21 can be cleaned easily. In the present invention, the pressure contact force between the photosensitive element 1 and the charging roller 21 is intensified only during electrostatic cleaning of the charging roller 21 carried out at the non-image forming area. Hence, the charging roller 21 is cleaned well as a result, without affecting the charging characteristic of the image area or impairing durability. Also, simply providing the pressure contact force modifying means 24 does away with the need for providing a cleaning member for cleaning the charging roller 21. This allows preventing cost increases.

The pressure contact force is modified by the pressure contact force modifying means 24 when the surface of the photosensitive element 1 moves during image formation start, or when the surface of the photosensitive element 1 moves during image formation termination. Thanks to such timings, no loss of productivity is incurred on account of time dedicated for cleaning the charging roller 21.

As the charging member there can be used a member configured so as to have a movable surface, such as the charging roller 21 or the charging brush roller 31. This allows increasing the surface area of the charging member, enhancing the durability of the latter.

The pressure contact force can be modified easily and inexpensively by using, as the pressure contact force modifying means 24, an eccentric cam 25 for urging the charging roller 21 towards the photosensitive element 1.

The pressure contact force can also be modified easily and inexpensively by using, as the pressure contact force modifying means 24, a piezoelectric member 26 for urging the charging roller 21 towards the photosensitive element 1, and voltage application means for applying voltage to the piezoelectric member 26.

The pressure contact force can be likewise modified easily and inexpensively by using, as the pressure contact force modifying means 24, a magnetostrictive member 27 for urging the charging roller 21 towards the photosensitive element 1, and magnetic field applying means for applying a magnetic field to the magnetostrictive member 27.

The pressure contact force modifying means 24 increases the pressure contact force in such a way that the nip width between the photosensitive element 1 and the charging roller 21 is not smaller than 2 mm. When the nip width is smaller than 2 mm, frictional forces are weak and no sufficient sliding friction length can be obtained. Good cleaning performance is achieved when the nip width is 2 mm or wider.

After modification of the charging bias applied to the charging roller 21 at the non-image forming area, the pressure contact force modifying means may increase the pressure contact force of the charging roller 21 against the photosensitive element 1 making it greater than that at the image forming area. In this case the charging roller 21 is cleaned electrostatically, and the amount of toner is reduced. The little toner remaining adhered to the charging roller 21 is cleaned by frictional forces through contact with the photosensitive element 1. The charging roller 21 can be effectively cleaned thereby.

The charging bias voltage applied to the charging roller 21 is voltage resulting from superposing AC voltage on DC voltage, at the image forming area, and DC voltage at the non-image forming area. This affords uniform charging at the image forming area while increasing the electrostatic cleaning ability at the non-image forming area.

In the present embodiment there are used negatively-charged toner, and a charging bias voltage of −200 to −1500 V at the image forming area.

Charging can be made more uniform by using an elastic roller as the charging member.

Also, cleaning ability can be enhanced by using a brush roller as the charging member. This enhanced cleaning performance is ostensibly the result of the increased contact area between the charging member and the photosensitive element 1 brought about by the greater pressure contact force and amount of bite afforded by the brush, since not only the tips but also the roots of the brush come into contact with the photosensitive element 1.

Preferably, the photosensitive element 1 used has a surface friction coefficient of 0.1 to 0.5. When the surface friction coefficient of the photosensitive element is smaller than 0.1 cleaning ability becomes dramatically impaired. On the other hand, a surface friction coefficient greater than 0.5 results in good cleaning ability, but also in substantial wear of the photosensitive element, which impairs the durability thereof.

Thus, increasing the pressure contact force of the charging member against the image carrier during electrostatic cleaning of the charging member has the effect of widening the nip width between the charging member and the image carrier, and of increasing the force with which the image carrier slides frictionally against the surface of the charging member. Toner adhered to the charging member, in addition to being electrostatically oriented towards the image carrier, is detached readily from the charging member, also mechanically, through sliding friction against the image carrier with a large nip width and large frictional forces Thereby, even toner strongly adhered to the charging member can be cleaned easily.

When the pressure contact force between the charging member and the image carrier at the image forming area is increased, uniform charging may fail to be obtained, and toner adhering electrostatically to the charging member may be likelier, on the contrary, to become embedded into the charging member. Intense pressure contact force at normal times can give rise to problems such as filming or the like caused by wear of the image carrier and/or components adhering to the image carrier. In the present invention, the pressure contact force between the image carrier and the charging member is intensified only during electrostatic cleaning of the charging member, carried out at the non-image forming area relating to the surface movement direction of the image carrier. Hence, the charging member is cleaned well as a result, without affecting the charging characteristic of the image area or impairing durability. Also, simply providing pressure contact force modifying means does away with the need for providing a cleaning member for cleaning the charging member. This allows preventing cost increases.

The invention affords thus the superior effect of allowing the charging member of a contact-type charging device to be cleaned well and inexpensively.

Various modifications will become possible for those skilled in the art after receiving the teachings of the present disclosure without departing from the scope thereof.

What is claimed is:

1. An image forming apparatus, comprising:

a charging device configured to charge a surface of an image carrier with a moving surface, by bringing a charging member, to which voltage is applied, into pressure-contact with the image carrier;

an electrostatic latent image forming device configured to form an electrostatic latent image on the image carrier;

a developing device configured to develop an electrostatic latent image on the image carrier;

an application device configured to apply, to the charging member, voltage for forming an electric field such that toner adhered to a surface of the charging member at a non-image forming area is oriented towards the image carrier; and pressure contact force modifying means for making a pressure contact force of the charging member against the image carrier at the non-image forming area greater than that at an image forming area, wherein the pressure contact force modifying means comprises a magnetostrictive member configured to urge the charging member against the image carrier, and magnetic field application means for applying a magnetic field to the magnetostrictive member.

2. An image forming apparatus, comprising:

a charging device configured to charge a surface of an image carrier with a moving surface, by bringing a charging member, to which voltage is applied, into pressure-contact with the image carrier;

an electrostatic latent image forming device configured to form an electrostatic latent image on the image carrier;

a developing device configured to develop an electrostatic latent image on the image carrier;

an application device configured to apply, to the charging member, voltage for forming an electric field such that toner adhered to a surface of the charging member at a non-image forming area is oriented towards the image carrier; and pressure contact force modifying means for making a pressure contact force of the charging member against the image carrier at the non-image forming area greater than that at an image forming area, wherein the pressure contact force modifying means increases the pressure contact force such that a nip width between the image carrier and the charging member is not less than 2 mm.

3. The image forming apparatus as claimed in claim 2, wherein the pressure contact force modifying means modifies the pressure contact force when the surface of the image carrier moves upon starting image formation start, or when the surface of the image carrier moves upon terminating image formation.

4. The image forming apparatus as claimed in claim 2, wherein the charging member is configured to include a movable surface.

5. The image forming apparatus as claimed in claim 2, wherein the pressure contact force modifying means is an eccentric cam configured to urge the charging member against the image carrier.

6. The image forming apparatus as claimed in claim 2, wherein the pressure contact force modifying means comprises a piezoelectric member configured to urge the charging member against the image carrier, and voltage application means for applying voltage to the piezoelectric member.

7. The image forming apparatus as claimed in claim 2, wherein after application of voltage, to the charging member, for forming an electric field such that toner adhered to the surface of the charging member at the non-image forming area is oriented towards the image carrier, the pressure contact force modifying means makes the pressure contact force of the charging member against the image carrier greater than that at the image forming area.

8. The image forming apparatus as claimed in claim 2, wherein the developing device uses negatively-charged toner, and the voltage applied to the charging member at the image forming area is −200 to −1500 V.

9. The image forming apparatus as claimed in claim 2, wherein the charging member is an elastic roller.

10. The image forming apparatus as claimed in claim 2, wherein the charging member is a brush roller.

11. The image forming apparatus as claimed in claim 2, wherein a surface friction coefficient of the image carrier is 0.15 to 0.5.

12. An image forming apparatus, comprising:

a charging device configured to charge a surface of an image carrier with a moving surface, by bringing a charging member, to which voltage is applied, into pressure-contact with the image carrier;

an electrostatic latent image forming device configured to form an electrostatic latent image on the image carrier;

a developing device configured to develop an electrostatic latent image on the image carrier;

an application device configured to apply, to the charging member, voltage for forming an electric field such that toner adhered to a surface of the charging member at a non-image forming area is oriented towards the image carrier; and pressure contact force modifying means for making a pressure contact force of the charging member against the image carrier at the non-image forming area greater than that at an image forming area, wherein at the image forming area relating to the surface motion direction of the image carrier, the voltage applied to the charging member is voltage resulting from superposing AC onto DC, while at the non-image forming area, the voltage applied to the charging member is DC voltage.

* * * * *